United States Patent [19]

Lloyd-Jones

[11] 4,347,691

[45] Sep. 7, 1982

[54] SOFFIT AND FASCIA PANEL

[75] Inventor: Robert Lloyd-Jones, Redcliffe, Australia

[73] Assignee: Salkhad Pty. Limited, Queensland, Australia

[21] Appl. No.: 207,975

[22] Filed: Nov. 18, 1980

[30] Foreign Application Priority Data

Aug. 4, 1980 [AU] Australia ..... PE4838
Sep. 19, 1980 [AU] Australia ..... PE5655

[51] Int. Cl.[3] ..... E04D 13/15
[52] U.S. Cl. ..... 52/95
[58] Field of Search ..... 52/95, 96, 738, 94, 52/11

[56] References Cited

U.S. PATENT DOCUMENTS 2,722,901 11/1955 Johnson et al. ..... 52/94
2,873,698 2/1959 Hartman et al. ..... 52/94
3,241,273 3/1966 Struben ..... 52/94
3,826,048 7/1974 Merkin et al. ..... 52/94
4,109,428 8/1978 Aarons ..... 52/94

FOREIGN PATENT DOCUMENTS 1007419 3/1977 Canada ..... 52/94

*Primary Examiner*—John E. Murtagh
*Assistant Examiner*—Eugene R. Washington
*Attorney, Agent, or Firm*—D. Paul Weaver

[57] ABSTRACT

A single piece of sheet material is shaped to substantially uniform cross-section to comprise a soffit section to be fixed under the projecting rafters of a building frame, an attachment flange depending from the rear of the soffit section, for attachment to the wall of the frame, a fascia section extending up from the front of the soffit section to cover the front ends of the rafters, and a fascia top piece extending rearwardly from the top of the fascia to lie over the front end portions of the rafters.

2 Claims, 4 Drawing Figures

SOFFIT AND FASCIA PANEL

BACKGROUND OF THE INVENTION

This invention relates to a soffit and fascia panel.

A considerable amount of time, labour and expense is involved in the installation of the facias and soffits of a house, and the main object of the present invention is to provide pre-fabricated panels, which are simple and economical to manufacture, and which may be quickly and easily installed on a house frame to form an integrated soffit and fascia.

BRIEF SUMMARY OF THE INVENTION

According to the invention, a soffit and fascia panel comprises a single member of sheet material roll-formed or otherwise shaped to substantially uniform cross-section and including a substantially flat soffit section with parallel front and rear edges, adapted to be installed below the extended end portions of rafters of a building frame, an integral soffit attachment flange extending down from the rear edge of the soffit section and adapted to be attached to a wall of the building frame. An integral fascia section extends upwardly from the front edge of the soffit section and is adapted to lie in front of the extremities of the rafters, and an integral fascia top piece extending rearwardly from the top of the fascia section to overlie the extremities of the rafters. Other features of the invention will become apparent from the following description.

BRIEF DESCRIPTION OF THE DRAWINGS

In order that the invention may be readily understood and carried into practical effect, reference is now made to the accompanying drawings, wherein.

DETAILED DESCRIPTION OF THE PREFERRED EMBODIMENTS

Figure 1:
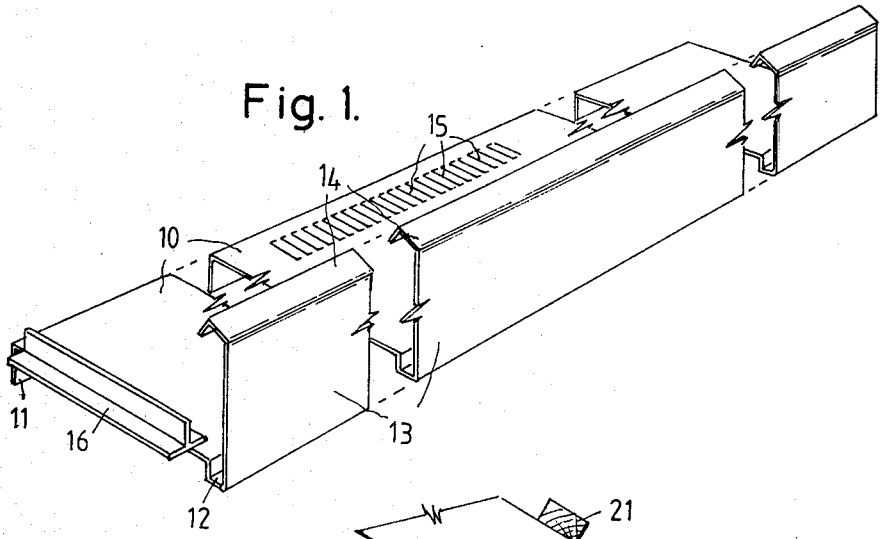
FIG. 1 is a partly broken-away perspective view of a soffit and fascia panel according to the invention.

A soffit and fascia panel as illustrated may suitably be made of a single section of sheet metal shaped, for example by roll-forming, to the required cross-sectional configuration. Sheet steel which has been treated against corrosion by a coating of zinc and aluminum, and has been additionally coated on one side with polyvinyl chloride, to give an attractively coloured and durable finish, is well suited to the construction of the panels.

Referring initially to the embodiment of the invention shown in FIGS. 1 and 2 of the drawings, the coated sheet metal is shaped to form a flat and normally horizontal soffit section 10 of which one edge portion, hereinafter called the rear edge, is down-turned through a right angle to form a soffit attachment flange 11. At the other, or front, edge of the soffit section 10, the sheet metal is bent down through a right angle, forwardly through a right angle, and then upwardly through a right angle so there is formed a narrow rectangular channel 12, of which the fairly high normally vertical front flange constitutes a fascia section 13. The top edge portion of the fascia section is bent through an obtuse angle to incline upwardly towards the rear, and further bent through a right angle to extend downwards, this angled part being a fascia top piece 14. The sheet metal is arranged, during shaping, so that its PVC coating is on the weather side of the panel, that is, at the underside of the soffit section 10 and the front of the fascia section 13.

Ventilation apertures are formed in the soffit section 10, for example by forming a series of parallel transverse cuts near to the rear side of this section and deforming the metal between the cuts to louvred ventilation openings 15.

The soffit and fascia panels may be made in long sections, but it may be necessary to connect two or more panels end to end, in which case this may be done by means of a T-section bar 16 of extruded metal riveted or otherwise secured above the junction of succeeding soffit sections 10, and by the use of appropriately profiled connector pieces (not shown) fitted and riveted or otherwise secured between the adjacent ends of fascia sections 13.

Figure 2:
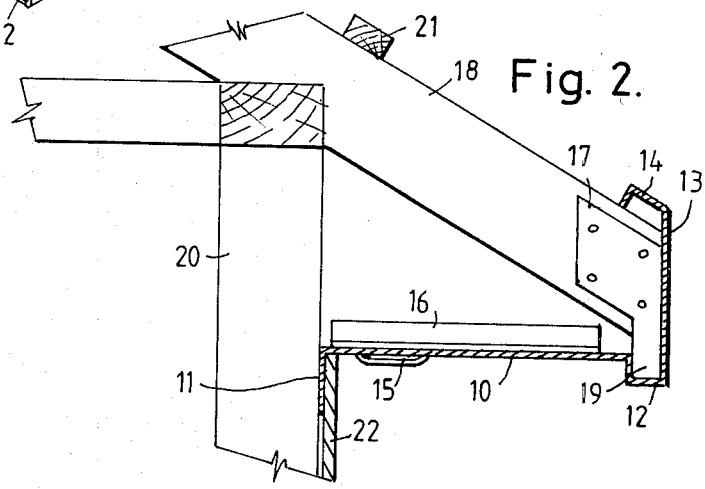
FIG. 2 is a sectional view of part of a house frame showing the soffit and fascia panel installed.

As shown in FIG. 2 of the drawings, the panel is located for fixing to the timber frame of a house by the use of simple sheet metal alignment brackets 17 nailed to the outer ends of rafters 18, each bracket having a front edge which is aligned vertically, to register with the end of the rafter, and having a downward projection 19. The soffit and fascia panel is positioned so its channel 12 is fitted closely to the projections 19 of the brackets 17 and the fascia top piece 14 overlies the rafters 18. The soffit attachment flange 11 is nailed to the studs 20 of the frame. The fascia section 13, being located against the ends of the rafters 18, may be fixed by the subsequent nailing of conventional gutter supporting brackets (not shown) through the fascia section to some of the rafters. The top piece 14 of the fascia section 13 overlying the ends of the rafters 18, serves in place of the usual lowermost roof batten and with other battens provided, one being indicated at 21, supports tiles or other roofing (not shown) fixed to the house roof structure in usual manner. The soffit attachment flange 11 is concealed by the subsequent attachment of external wall cladding 22.

The soffit and fascia panels may be very simply and economically manufactured, and may be very quickly and easily installed without any high degree of skill being required to present a neat and attractive appearance not readily distinguishable from that of conventional soffit and fascia constructions, the installation of which is likely to involve much more time, labour and expense.

Figure 3:
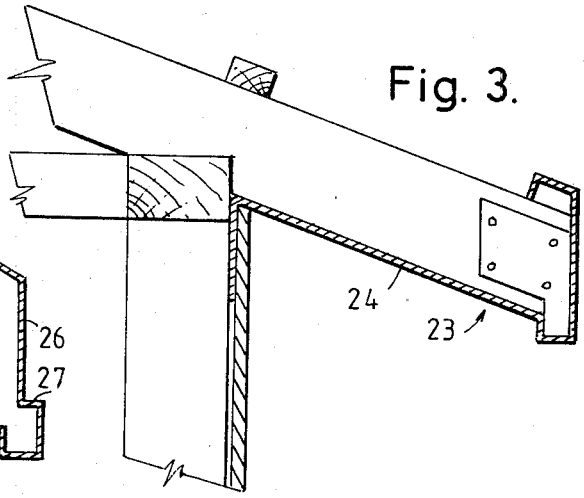
FIG. 3 is a view, similar to FIG. 2, showing a modified form of soffit and facia panel.

In the modified form of the invention shown in FIG. 3, the soffit and fascia panel 23 is generally as before described except that its soffit section 24, when the panel is installed, lies closely under the extended end portions of the rafters of the roof structure.

Figure 4:
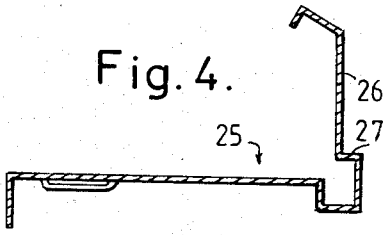
FIG. 4 is an end view of a soffit and fascia panel according to another modified form of the invention.

In the embodiment of the invention shown in FIG. 4, the soffit and fascia panel 25 has a fascia section 26 which, instead of presenting a plane front surface, as shown in FIGS. 1 and 2, and in FIG. 3, is instead shaped to form a step at 27, some distance above the bottom of the fascia section, to facilitate the alignment and installation of a gutter (not shown) in front of the fascia section.

I claim:

1. A one piece soffit and fascia panel for a building having a vertical wall structure and inclined roof rafters extending outwardly of the wall structure, said panel comprising a substantially level soffit section of uniform width extending forwardly of the wall structure substantially at right angles thereto, an integral downturned flange carried by the inner edge of the soffit section adapted to abut and be secured to the wall structure, said soffit section and downturned flange being disposed bodily below said rafters, the substantially vertical fascia section extending above the soffit section and substantially abutting and lying across the ends of the rafters, vertical alignment brackets for said panel fixed to side faces of the rafters and having depending extensions projecting somewhat below the outer ends of the rafters and below the level of the soffit section of said panel, and said panel having an integral relatively narrow uniform cross section continuous channel portion formed thereon and receiving therein said depending extensions of the alignment brackets and said channel forming the juncture of the soffit and fascia sections.

2. A one piece soffit and fascia panel as defined in claim 6, and a fascia top piece of uniform cross section and being continuous on said panel and projecting rearwardly of the fascia section and overlapping the tops of the rafters along their outer end portions and resting on and being supported by the rafters.

* * * * *